United States Patent [19]

Anderson

[11] 3,987,335

[45] Oct. 19, 1976

[54] ELECTRODELESS FLUORESCENT LAMP BULB RF POWER ENERGIZED THROUGH MAGNETIC CORE LOCATED PARTIALLY WITHIN GAS DISCHARGE SPACE

[75] Inventor: John M. Anderson, Scotia, N.Y.

[73] Assignee: General Electric Company, Schenectady, N.Y.

[22] Filed: Dec. 18, 1975

[21] Appl. No.: 642,148

Related U.S. Application Data

[63] Continuation-in-part of Ser. No. 542,447, Jan. 20, 1975, abandoned.

[52] U.S. Cl. ..... 315/62; 313/491; 313/493; 315/248; 315/276; 315/348; 315/57

[51] Int. Cl.[2] ..... H05B 41/24

[58] Field of Search ..... 315/57.62, 70, 248, 315/276, DIG. 2, DIG. 5, DIG. 7, 344, 267, 39; 313/485, 486–493, 201, 44

[56] References Cited

UNITED STATES PATENTS

| | | | |
|---|---|---|---|
| 966,204 | 8/1910 | Hewitt | 315/248 |
| 2,030,957 | 2/1936 | Bethenod et al. | 315/248 |
| 2,118,452 | 5/1938 | Le Bel | 315/248 |
| 3,500,118 | 3/1970 | Anderson | 315/57 |
| 3,521,120 | 7/1970 | Anderson | 315/57 |
| 3,551,742 | 12/1970 | Gruzdev et al. | 315/248 |
| 3,611,009 | 10/1971 | McNeil | 315/57 |

*Primary Examiner*—Alfred E. Smith
*Assistant Examiner*—Tommy P. Chin
*Attorney, Agent, or Firm*—Jack E. Haken; Joseph T. Cohen; Jerome C. Squillaro

[57] ABSTRACT

An induction-ionized, electrodeless fluorescent lamp comprises a phosphor coated, globular envelope. An ionizable gas is contained in the envelope to produce radiation which excites the phosphor to produce light. A closed loop, magnetic core lying partially within and partially without the envelope couples radio frequency energy into the gas to produce ionization. The core may be bonded to a metal strap or enclosed in a metal container to improve heat transfer from the surrounding air. Primary windings and heat radiators are attached to the core outside the lamp envelope thereby eliminating the feed-through structures of other lamp embodiments.

A radio frequency power supply and lamp base plug are attached to the envelope providing a lamp which is physically and electrically compatible with existing incandescent-type lamp equipment.

21 Claims, 8 Drawing Figures

Fig. 5
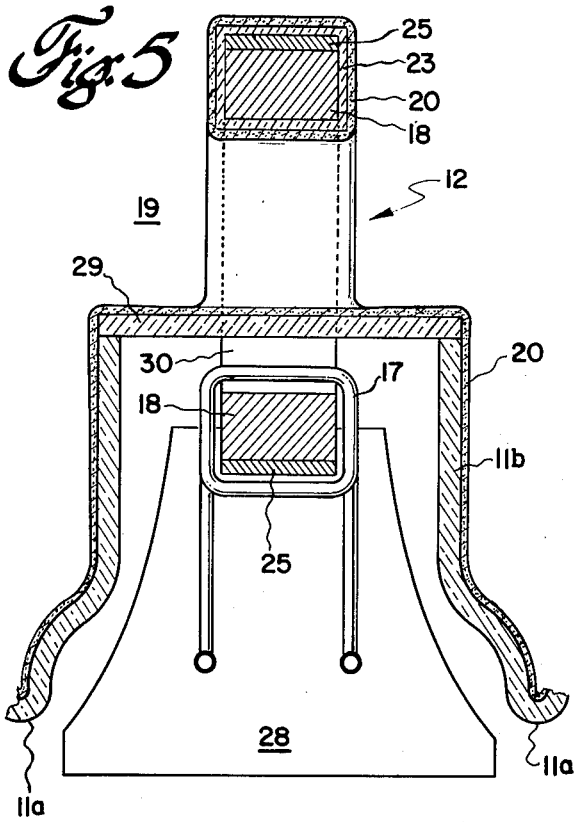
Fig. 6
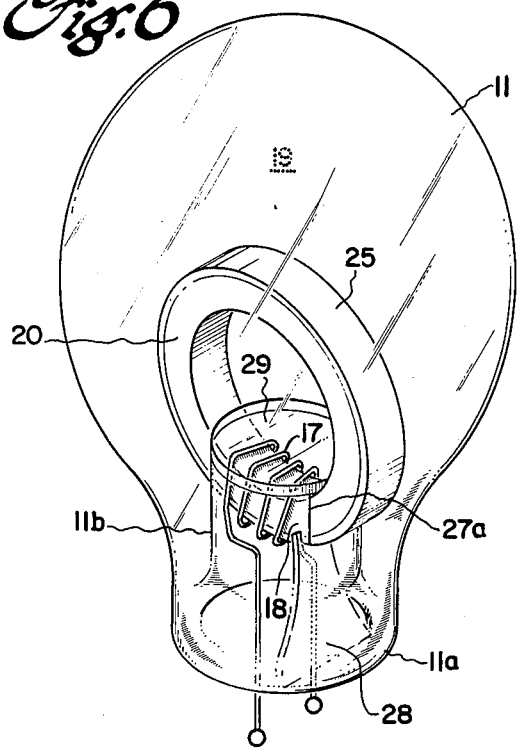
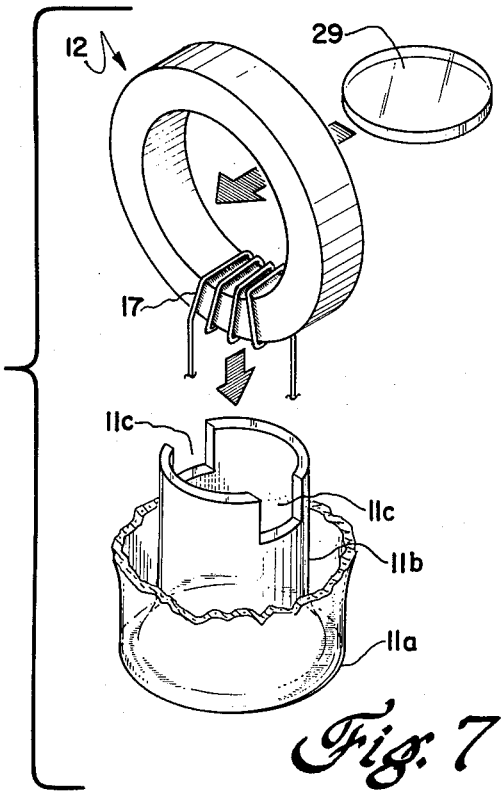
Fig. 7
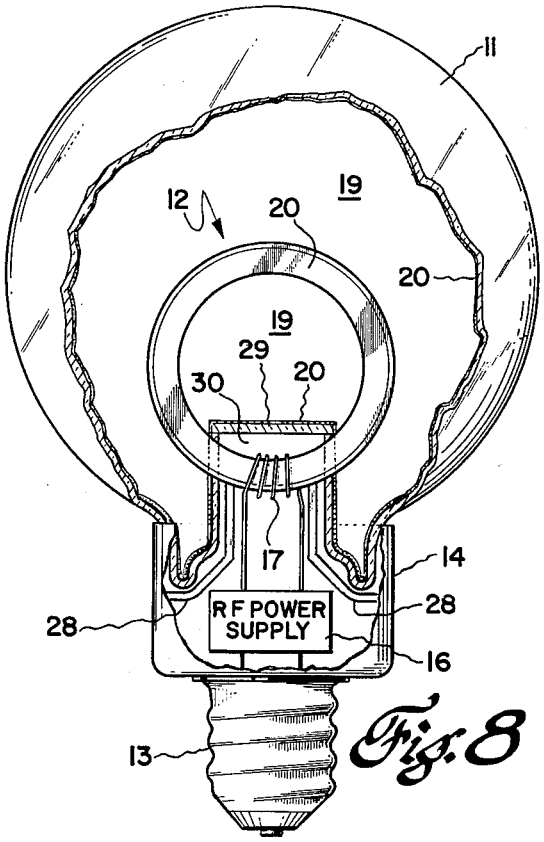
Fig. 8

ELECTRODELESS FLUORESCENT LAMP BULB RF POWER ENERGIZED THROUGH MAGNETIC CORE LOCATED PARTIALLY WITHIN GAS DISCHARGE SPACE

CROSS REFERENCE, CONCURRENT APPLICATIONS, AND INCORPORATION BY REFERENCE

This is a continuation-in-part of U.S. Pat. application No. 542,447, filed Jan. 20, 1975 now abandoned.

The present invention relates to concurrently filed U.S. Pat. applications Ser. No. 642,142, John M. Anderson, and Ser. No. 642,156 Homer H. Glascock and John M. Anderson, said patent applications having been assigned to the assignee of this patent application. The principles of operation of induction ionized fluorescent lamps using ferrite core transformers are disclosed in U.S. Pat. Nos. 3,500,118 issued Mar. 10, 1970 and 3,521,120 issued July 21, 1970 to John M. Anderson.

The disclosures of the above-referenced patents and applications are incorporated by reference into this patent application.

BACKGROUND OF THE INVENTION

This invention relates to fluorescent lamps which are adapted as direct replacements for existing incandescent lamps. More specifically, this invention concerns fluorescent lamps wherein ionization is induced by a transformer which is partially contained within the lamp envelope.

The incandescent lamp is the primary luminary for household and residential lighting. This lamp generally includes an incandescent filament within a predetermined nonoxidizing atmosphere which is contained within a teardrop shaped envelope and mounted, for example, within an Edison type base which is screwed into a permanent fixture or into a movable socket.

Despite their widespread use, incandescent lamps are relatively inefficient, producing only 15–17 lumens per watt of input power and have relatively short, unpredictable service lives. Fluorescent lamps, which have efficiencies as high as 80 lumens per watt, provide an attractive alternative to incandescent lighting. Conventional fluorescent lamps, however, require a long tubular envelope which, together with the need for auxiliary ballasting equipment, has somewhat limited their acceptance in the home lighting market. Increased residential use of fluorescent illumination, with attendant savings of energy, can be achieved from the development of fluorescent lamps which are directly compatible with existing sockets and incandescent lamp fixtures.

The electric lamp technology has long sought electric discharge devices which produce visible light for general illumination purposes without the utilization of electrodes as the footpoints of a glow or arc discharge. Although the concept of electrodeless discharge lamps is very old, such lamps have always included the concept of coupling electrical energy into an hermetically sealed gas-containing envelope by means of a ferromagnetic or air core transformer to avoid the use of electrodes. Such devices have never proved practical or commercially feasible, because it has been impossible to achieve any reasonable efficiency of light emission due to the utilization of iron or air core transformers because of core losses, among other factors.

It has been proposed in the prior art to excite electrodeless gaseous discharge lamps using electromagnetic induction to transfer electric energy into the discharge vessel. Experiments along this line disclose that heretofore such means have been highly impracticable. If an air core transformer is utilized, the inefficiency of the coupling procedure required to achieve a reasonable power input to the gaseous discharge results in a loss of power by radiation which is prohibitive, and which may be dangerous. Accordingly, such devices have never been successfully operated for useful periods at any reasonable efficiency.

Another alternative that has been proposed in the prior art is the utilization of iron or ferromagnetic cores. Such cores, however, may be utilized only at very low frequencies in order that eddy current heating of the iron does not cause core failure. Utilizing alternating current, it is exceedingly difficult to operate an iron core transformer for the purpose of transferring energy of this nature at frequencies in excess of five or ten kilohertz. Based upon experimental and calculated results obtained in this laboratory, it has been determined that for an iron core transformer operating at 50 kHz, core power losses are in the range of approximately 80 to 90 percent. Accordingly, from the foregoing it may readily be appreciated that air core and iron core transformers are, from a practical point of view, inoperative at the high radio frequency levels that are necessary for efficient operation of gaseous discharge lamps in accord with this invention.

In my prior U.S. Pat. 3,500,118 and 3,521,120, I disclosed fluorescent lamps which utilize a magnetically induced radio frequency electric field to ionize a gaseous radiating medium. The elimination of discharge electrodes within these lamp envelopes substantially increases their life and allows lamp shapes which are more compatible with home lighting needs.

My U.S. Pat. No. 3,500,118, issued Mar. 10, 1970, describes an improved electrodeless fluorescent lamp having a radio frequency power supply. This structure, while useful, was bulky comprising a large tubular discharge ring, several ferrite cores, and a remotely mounted power supply which made it unsuitable for use in many industrial and residential applications.

My later U.S. Pat. No. 3,521,120, issued July 21, 1970, describes a more compact lamp. However, this lamp maintains a high frequency magnetic field in the air surrounding the envelope and thus sometimes constitutes an unacceptable source of electromagnetic radiation and interference.

Briefly stated, my concurrently filed patent application Ser. No. 642,142 discloses fluorescent lamps which may be constructed within a spherical or teardrop shaped structure typical of residential incandescent lamps. A toroidal magnetic core contained within the lamp envelope is excited with a radio frequency magnetic field. The core induces an electric discharge in gas contained within the lamp. Radiation from this gas excites a conventional lamp phosphor on the inner surface of the envelope and on the outer surface of the core to produce visible light.

The magnetic core of the lamps disclosed in application Ser. No. 642,142 is contained wholly within the lamp envelope under vacuum conditions. Despite the improved efficiency of those lamps, up to a quarter of the radio frequency input power is dissipated within the core and winding structures. To provide for efficient operation, the operating temperature of ferrite cores and lamp phosphors are, generally, restricted to the region below 125°C. Thus, limited heat transfer from the transformer core is a major factor in determining the maximum light output available from thos lamps. Structures disclosed in my patent application Ser. No. 642,142, include metal rods for conducting heat through the lamp envelope so that it may be dissipated to the atmosphere.

The operation and efficiency of fluorescent lamps may be degraded if materials within the envelope act to contaminate the phosphors or to change the gas pressures. Many magnetic materials, which are otherwise suitable for use in these lamps, tend to outgas at lamp pressures and may evolve potentially damaging substances, for example oxygen and water vapor, into the envelope. In addition, many of these materials are generally unreceptive to the application of phosphor coatings. In accordance with the teachings of my concurrently filed patent application, Ser. No. 642,142, a thin glazing is applied to ferrite lamp components to improve the adherence of phosphors (which may then be applied using conventional Lehring processes) and to contain gases which may evolve from the cores.

SUMMARY OF THE INVENTION

In accordance with the present invention, I provide fluorescent lamp induction transformer structures wherein a portion of a closed magnetic core is mounted external to a lamp vacuum envelope. Large portions of these transformer core surfaces are exposed to the atmosphere to provide improved cooling and heat transfer from the core and winding structures. The transformer primary winding is placed on an external core segment which allows the use of less expensive winding materials than are required in other lamp embodiments. In one embodiment of the present invention, the transformer core structure is enclosed in a metal container having a surface which is receptive to phosphor application. The glassy layer which is applied to the core structure in other lamps is thereby eliminated. The transformer core structure may be sealed to a lamp base using a single glass disk seal.

It is therefore an object of this invention to provide a structure which allows improved cooling of electrodeless fluorescent lamps.

Another object of this invention is to provide an electrodeless fluorescent lamp transformer, having a closed magnetic path, which allows a primary winding to be mounted external to a lamp envelope.

Yet another object of this invention is to provide an electrodeless fluorescent lamp structure which does not require glazing of a core.

Yet another object of this invention is to provide a structure wherein the transformer structure of an electrodeless fluorescent lamp may be assembled to a vacuum envelope base using a single disk-shaped, glass, sealing member.

BRIEF DESCRIPTION OF THE DRAWINGS

The novel features believed to be characteristic of the present invention are set forth in the appended claims. The invention itself, together with further objects and advantages thereof, may best be understood with reference to the following detailed description, taken in connection with the appended drawings in which:

FIG. 5 is a front sectional view of the lamp structures of FIG. 4;

FIG. 6 is a view of the lamp structures of FIGS. 4 and 5;

FIG. 7 depicts a method of production of the lamp structures of FIGS. 4, 5, and 6; and FIG. 8 depicts a complete lamp structure including a power supply and a screw base.

DESCRIPTION OF THE PREFERRED EMBODIMENTS

Figure 1:
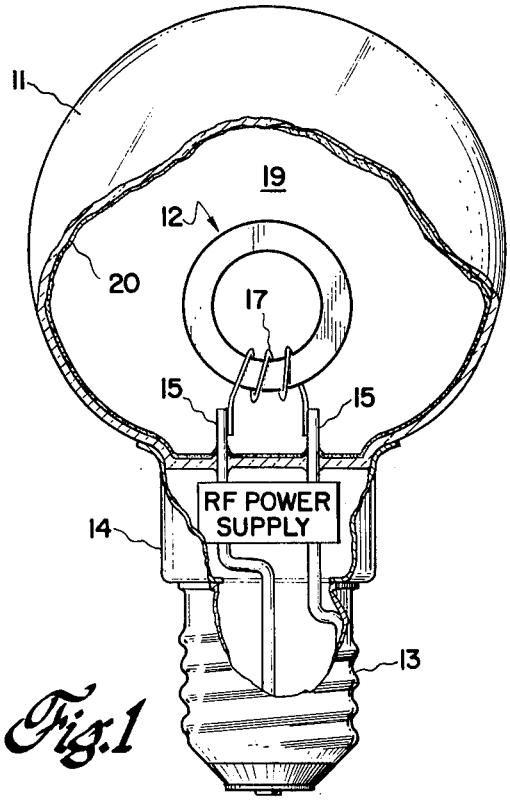
FIG. 1 is a front sectional view of an embodiment of an induction ionized fluorescent lamp.

The principles of operation of electrodeless fluorescent lamps are described in my U.S. Pat. Nos. 3,500,118 and 3,521,120 which are incorporated herein by reference. These principles may best be understood by reference to FIG. 1 which is a sectional view of an electrodeless fluorescent lamp having an induction transformer core wholly contained within an ionizable gas. A light transmissive, evacuable, envelope 11, is mounted on a base assembly 14 which supports a lamp base plug 13. A radio frequency power supply 16 contained within the base assembly causes current flow through metal rods 15 and a primary winding 17 which excites a radio frequency magnetic field in a toroidal transformer core 12, which is contained with the light transmissive envelope 11.

The radio frequency power supply 16 may be of any type known to the art. For example, the inverter circuit which is described in my U.S. Pat. No. 3,521,120 would be suitable for use with lamps operating in its power range.

The space within the envelope contains an ionizable gas 19 which links the transformer core. The radio frequency magnetic field within the transformer core 12 induces an electric field which ionizes and excites the gas 19. Upon excitation, the gas emits radiation in the ultraviolet region. The internal surfaces of the envelope 11 and, if desired, the external surfaces of the transformer core 12 are coated with an appropriate lamp phosphor 20, which phosphors are well known to the art. The phosphors are capable of absorbing ultraviolet radiation from the gas and, upon stimulation thereby, emitting radiation within the visible spectrum to produce a highly efficient and pleasing light output. In this embodiment of the invention, the ionized gas is not relied upon to produce substantial light emission, but rather, to produce radiation which causes light to be emitted from a luminescent phosphor. This, in a manner well known to the art, allows for highly efficient operation.

The gaseous medium 19 in lamps of this type is typically a mixture of rare gas (for example krypton and/or argon) and mercury vapor and/or cadmium vapor at a pressure between approximately 0.2 and approximately 3.0 torr.[1] These mixtures are poor thermal conductors and are generally insufficient to transfer the heat produced by losses within the transformer core 12 and winding 17.

[1] Except as otherwise noted, all pressures herein described are measured at room temperature.

Figure 2:
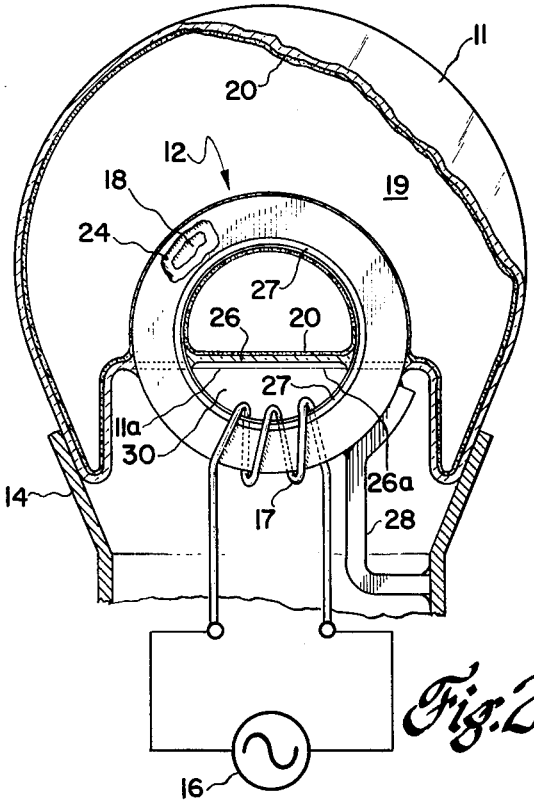
FIG. 2 is a sectional side view of a lamp structure incorporating the present invention.
Figure 3:
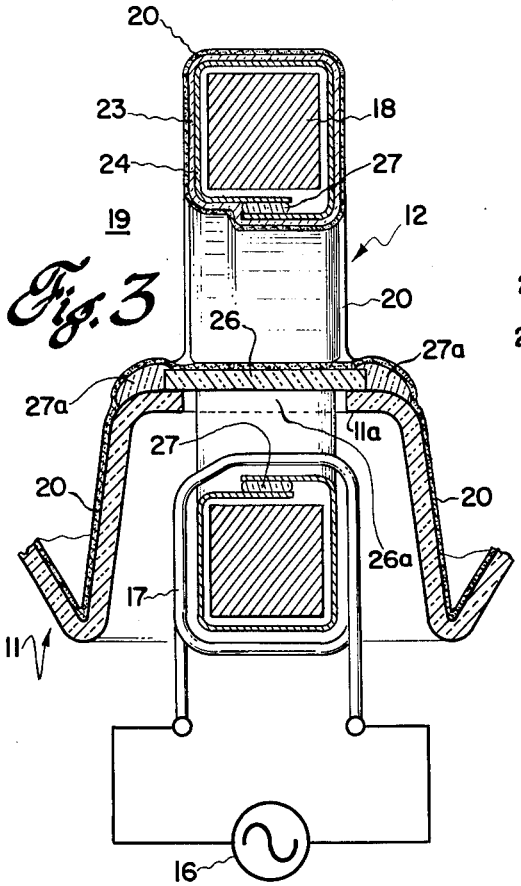
FIG. 3 is a front sectional view of the lamp structure of FIG. 2.

In accordance with one embodiment of the present invention, illustrated in FIG. 2, I provide structures whereby a transformer core assembly lies partially within and partially without a fluorescent lamp envelope. As in prior art lamps, an evacuable, light transmissive envelope 11, (which may, for example, be glass) is filled with a gaseous ionizing medium 19. The lamp envelope has a flat base area 11a having a rectangular slot 26a in which is mounted a transformer core assembly 12 having a central winding space 30, which, as depicted in FIG. 3, may comprise an annular magnetic core of rectangular cross section 18 enclosed with an annular metal container 24. The core assembly 12 lies partially within and partially without the lamp envelope 11 so that a minor segment of the core assembly 12 and space 30 contained by it extend into the atmosphere beyond the lamp envelope base 11*a*. The interior of the lamp envelope 11 and the exterior surfaces of the metal container 24, which lie within the lamp envelope, are coated with a phosphor 20 which may, for example, be any of the abovementioned fluorescent lamp phosphors. That portion of the rectangular slot 26*a* lying within the core winding space 30 is covered and sealed with a rectangular glass bridge 26. A primary winding 17 is wrapped around the metal container 24 through the winding space segment 30. Current from a radio frequency power supply 16 flows through the winding 17, exciting the core with a magnetic field which acts to induce excitation of the gaseous medium and production of visible light output in the manner described above. A heat sink 28 is bonded to the metal container 24 at a point outside the lamp envelope 11. Heat transferred to the sink 28 is dissipated to the atmosphere or conducted to a suitable radiator on a lamp base (not shown). Details of the metal container 24 construction are shown in FIG. 3. The container may be constructed from copper, beryllium, aluminum, or any other metal compatible with the low pressure lamp atmosphere and suitable for receipt of the fluorescent lamp phosphor 20. The container 24 forms a smooth unbroken shell around the major circumference of the core 18, but contains a gap extending around its inner major circumference which prevents short circuiting of the induced electric field. Electrical insulation and vacuum integrity across this gap are maintained by a glass seal 27. The container 24 may be coated with a glassy layer 23 in order to improve adhesion of the phosphor 20.

Obviously, the choice of core material is an important factor in enabling operation of this lamp. Whereas prior art literature has described lamp configurations having air, iron, or other ferromagnetic cores, I have determined that the losses inherent in the operation of these prior art cores preclude the construction of a practical lamp. As indicated in the referenced patents, ferrite or similar magnetic core material must be chosen to provide high permeability and low internal heat loss at the operating frequency. As is well known in the art, a ferrite is a ceramic-like material characterized by ferrimagnetic properties and usually exhibits a spinel structure having a cubic crystal lattice and, for example, may have the generalized formula $Me\text{-}Fe_2O_4$ wherein Me represents a metal atom.

In accord with the present invention, it is necessary that the cores utilized be of such material and configuration that the core losses are not greater than 50 percent in order that effective coupling of electromagnetic energy into the light source may be effected. Similarly, low core losses reduce heating of the core and minimize the possibility of failure and maximize energy transfer efficiency. Preferably, core losses at the lamp operating temperature are maintained to less than 25 percent of total input power.

A high permeability core material is also necessary to assure adequate coupling of radio frequency energy to the gas with minimum electromagnetic radiation. Typically, a ferrite having a relative permeability of at least 2000 is preferable. Suitable ferrites are available having these characteristics over the frequency range from 25 kHz to 1 MHz. Although high frequency operation is desirable from the standpoint of minimizing core losses, the cost of presently available semiconductors for use in the radio frequency power supply 16 limits the maximum frequency at which a practical, economical lamp may be operated to approximately 50 kHz. Among other materials, I have found ferrite Type 8,100, manufactured by the Indiana General Corp. of Keysbee, New Jersey, and characterized by losses of less than 30 mw $cm^{-3}$ at 1000 gauss peak flux density for 50 kHz operation to be suitable for use in this lamp. Alternately, the core may comprise a composite of ferrite powder in a polyimide resin or any similar material having a magnetic permeability greater than 40. The ampere-turns in the transformer windings must, of course, be increased with core materials of this type.

Figure 4:
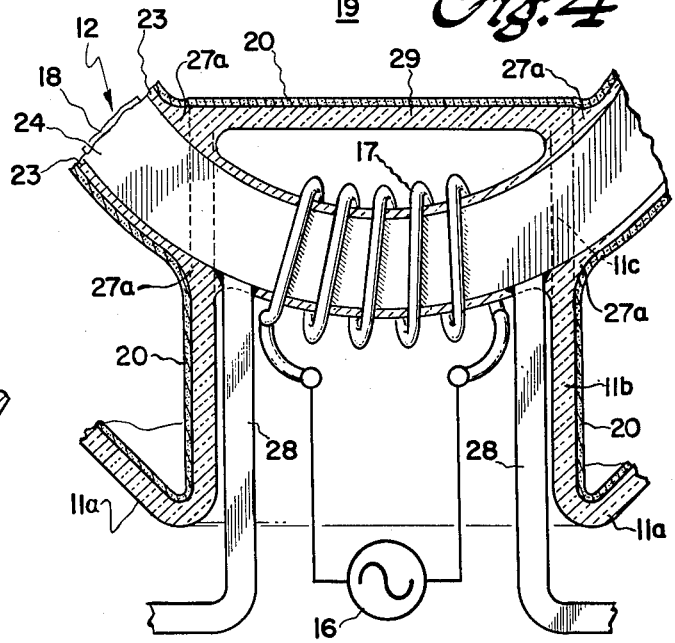
FIG. 4 is a partial side view of another embodiment of a lamp structure incorporating the present invention.

In another embodiment of this invention, shown in FIGS. 4, 5, and 6, a transformer core assembly 12 is supported by a reentrant tubulation 11*b* extending from the lamp base 11*a*. The core assembly 12 passes through a pair of slots 11*c* in the sides of the tubulation 11*b* and is secured thereto by glass seals 27*a*. A circular cover 29 closes the top of the slots and is sealed to the tubulation 11*b* and the internal surface of the transformer core assembly 12.

The core assembly 12 in this embodiment may comprise a core 18 which is wrapped about its outer circumference with a metal strap 25 which supports the core and aids in the removal of heat generated therein. Those portions of the strap 25 and the core 18 lying within the lamp envelope 11 may, for example, be coated with a glassy layer 23 to facilitate the receipt of the phosphor 20 and sealing to the cover 29 and the base tubulation 11*b*. As in the above-described embodiment, a transformer primary winding 17 is wrapped about the core and metal strap and is enclosed inside that portion of the core winding space 30 which is within the tubulation 11*b* which is exposed to the external atmosphere. A metal heat sink 28 is bonded to the strap 25 inside the tubulation 11*b* and serves to conduct heat away from the core assembly 12.

Further details of the lamp construction are shown in FIG. 7 which depicts the lamp base 11*a* with the reentrant tubulation 11*b* and rectangular slots 11*c*. A disk-shaped glass cover 29 is indicated prior to mounting on the tubulation 11*b*.

The lamp may, by way of example, be constructed by first preforming a glass lamp base 11*a* with a reentrant tubulation 11*b* and rectangular slots 11*c*. A glass coated transformer core assembly 12 with a winding 17 attached is inserted in slots 11*c* and covered by a glass disk 29. Upon heating, the glass tubulation 11*b* fuses with the core coating layer and glass disk 29 to provide the vacuum seals (27*a* of FIGS. 3 and 4). The envelope upper shell (not shown) is then sealed to the base, exhausted. and filled with gas in a conventional manner. Alternatively, the transformer winding 17 may be applied to the core assembly 12 after the sealing process is complete.

Obviously, the construction of glass-to-ferrite seals is necessary for the practice of this invention. I have found that these seals may be constructed if, as is well known in the art, the thermal expansion coefficient of the sealing glass is matched to that of the ferrite. I have determined that applicable ferrites have linear expansion coefficients of approximately 11 ppm/°C at 400°C and a linear expansion with temperature to 700°C. Many glass types are available having coefficients of expansion in this range. For example, Corning Glass Type No. 1190, which is a potash soda lead type, has a coefficient of expansion of 12.4 ppm/°C and is suitable for ferrite sealing. Glass No. 1190 is commonly used for sealing to iron and is also suitable for sealing to beryllium which has an expansion coefficient of 11.6 ppm/°C.

FIG. 8 depicts a complete lamp assembly incorporating the principles of this invention. A lamp base plug 13, which may, for example, be an Edison screw base, is mounted to one end of a cylindrical base assembly 14. The base assembly 14 contains a suitable radio frequency power supply and ballast circuit 16 which is more completely described above and in my concurrently filed patent applications. The radio frequency power supply receives input, power line energy from the base plug 13 and transforms it to radio frequency current which is applied to the transformer core assembly 12 through a primary winding 17. A light transmissive, evacuable envelope 11 is coated with a phosphor 20 and is mounted to an end of the base assembly 14 opposite the plug 13. The base of the envelope 11*a* is enclosed by the base assembly 14 and supports a reentrant circular tubulation 11*b* through which the toroidal transformer assembly 12 is mounted. A circular glass disk 29 covers the innermost end of the tubulation and is sealed to the transformer core assembly 12 and the tubulation 11b. A fill gas 19, which may for example be a mixture of mercury vapor with krypton and/or argon, fills the envelope and links the transformer core assembly 12. The primary winding 17 links the transformer core assembly 12 with a plurality of turns and lies within the envelope tubulation 11b. A heat sink 28 is bonded to the transformer core assembly 12 within the tubulation 11*b* and serves to conduct away heat. The space within the tubulation 11*b* and the base assembly 14 may, if desired, be filled with a thermally-conductive resinous material (not shown) to further improve heat transfer from the core assembly.

From the above description of the preferred embodiments, it may be seen that I have provided a structure affording greatly improved heat transfer characteristics from the windings and core of an electrodeless fluorescent lamp. The transformer core of this lamp is partially contained within the lamp envelope which allows construction of a lamp with highly efficient electrical coupling between the transformer and a gaseous ionizing medium and with a shape compatible with residential incandescent lamps and luminaires. Further, the transformer core lies partially outside of the lamp envelope, eliminating the need for the electrical, vacuum feedthroughs, characteristic of other lamps while affording increased heat transfer from the core and winding assemblies. The transformer core may be easily mounted to a lamp envelope base using simple, glass preform structures.

Although specific embodiments of the core structure 12 have been described in the above-mentioned preferred embodiments, it is to be understood that each of the lamps of the present invention may be constructed using any of the above-described core structures or those core structures described in the above-referenced concurrently filed United States patent applications.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

The invention claimed is:

1. An improved fluorescent lamp comprising:

an evacuable, light-transmissive envelope having a substantially globular upper shell;

a closed loop magnetic core structure, having a central opening, lying partially within and partially without said envelope;

means for energizing said core with a radio frequency magnetic field;

a gaseous medium within said envelope adapted to sustain an electric discharge due to an electric field induced therein by said magnetic core and to emit radiation at a first wavelength when sustaining said discharge; and a luminescent phosphor disposed on the interior of said envelope, said phosphor being adapted to emit visible light when excited by said first wavelength radiation.

2. The lamp of claim 1 further comprising a layer of gas impermeable, glass material disposed on said core structure and adapted for receipt of said phosphor, whereby gases contained in said core structure are separated from said gaseous medium and the adhesion of said phosphor to said core structure is facilitated.

3. The lamp of claim 1 wherein:

said envelope further comprises a flat base part defining a substantially rectangular perforation through which said core structure sealably penetrates said envelope, and said core structure has a substantially rectangular cross section.

4. The lamp of claim 3 further comprising a rectangular bridge element sealed to said core structure and to said envelope and covering said rectangular perforation within said central space of said core structure.

5. The lamp of claim 4 wherein said means for energizing said core structure comprises:

a winding linking the portion of said core structure lying without said envelope with a plurality of turns and a radio frequency power supply connected to said winding and adapted to receive input energy at line voltage and frequency and to convert said input energy to a radio frequency electric current in said winding, whereby said radio frequency magnetic field is induced in said core structure.

6. The lamp of claim 5 further comprising:

a hollow cylindrical base member, having a first end attached to said envelope, enclosing said portions of said core structure lying without said envelope and further enclosing said radio frequency power supply; and means for receiving said input energy, attached to an end of said base member opposite said envelope.

7. The lamp of claim 6 wherein said means for receiving said input energy comprises a lamp base plug.

8. The lamp of claim 1 wherein said core structure comprises:

an annular magnetic core having low losses and high permeability at frequencies between approximately 25 kHz and approximately 1 MHz;

an annular metal container enclosing said magnetic core, said metal container defining an open perforation extending about its inner major circumference; and a dielectric material filling said perforation whereby electrical conduction about the minor circumference of said container is prevented.

9. The lamp of claim 8 wherein said metal container is evacuable.

10. An improved fluorescent lamp comprising:

an evacuable, light-transmissive envelope having a substantially globular upper shell, a substantially flat base part, and a reentrant tubular projection defining two oppositely positioned perforations and extending from said base part;

a closed loop magnetic core structure, having a central opening, sealably penetrating said envelope through said perforations;

means for energizing said core structure with a radio frequency magnetic field;

a gaseous medium, contained within said envelope and linking said core structure, adapted to sustain an electric discharge due to an electric field induced therein by said magnetic core structure and to emit radiation at a first wavelength when sustaining said discharge; and a luminescent phosphor disposed on the interior of said envelope and on the surfaces of said magnetic core structure lying within said envelope, said phosphor being adapted to emit visible light when excited by said first wavelength radiation.

11. The lamp of claim 10 wherein said perforations lie adjacent to the inwardly directed end of said tubular projection and the inwardly directed end of said tubulation and said magnetic core structure are sealed to a flat disk.

12. The lamp of claim 11 wherein said means for energizing said core structure comprises a winding linking said core with a plurality of turns and lying within said tubulation and means for energizing said winding with a radio frequency electric current, said current having a frequency between approximately 25 kHz and approximately 1 MHz.

13. The lamp of claim 12 wherein the means for energizing said winding comprise:

a cylindrical base asembly having one end attached to said base part of said envelope;

a radio frequency power supply contained in said base assembly and adapted to receive input energy at line voltage and frequency and to convert said input energy to said radio frequency electric current in said winding; and a lamp base plug attached to said base assembly at an end opposite said envelope and adapted to receive said input energy from existing lamp sockets and to supply said input energy to said radio frequency power supply.

14. The lamp of claim 13 wherein said magnetic core structure comprises:

an annular magnetic core having high permeability and low losses at frequencies between approximately 25 kHz and approximately 1 MHz;

a flat metal strap surrounding the outer major circumference of said magnetic core; and a layer of gas-impermeable, glassy material disposed on said magnetic core and said flat metal strap.

15. The lamp of claim 14 wherein said core comprises ferrite.

16. The lamp of claim 14 wherein said flat metal strap comprises materials selected from the group consisting of copper and aluminum.

17. The lamp of claim 14 further comprising heat-dissipating means bonded to said flat metal strap within said tubular projection of said envelope.

18. The lamp of claim 17 wherein said gaseous medium comprises a mixture of rare gas and a gas selected from the group consisting of mercury vapor, cadmium vapor and mixtures thereof.

19. The lamp of claim 18 wherein said gaseous medium has a pressure between approximately 0.2 torr and approximately 3.0 torr.

20. The lamp of claim 19 wherein said rare gas comprises gases selected from the group consisting of krypton, argon, and mixtures thereof.

21. The lamp of claim 17 wherein said envelope comprises glass.

* * * * *